US009476288B2

(12) United States Patent
Hazelip

(10) Patent No.: US 9,476,288 B2
(45) Date of Patent: Oct. 25, 2016

(54) STEPPED LINER HANGER EXPANDER

(71) Applicant: Halliburton Energy Services, Inc., Houston, TX (US)

(72) Inventor: Gary Lynn Hazelip, Frisco, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 52 days.

(21) Appl. No.: 14/368,652

(22) PCT Filed: Jan. 10, 2013

(86) PCT No.: PCT/US2013/021079

§ 371 (c)(1),
(2) Date: Jun. 25, 2014

(87) PCT Pub. No.: WO2014/109752

PCT Pub. Date: Jul. 17, 2014

(65) Prior Publication Data

US 2015/0369021 A1 Dec. 24, 2015

(51) Int. Cl.

| | |
|---|---|
| ***E21B 33/128*** | (2006.01) |
| ***E21B 43/10*** | (2006.01) |
| ***E21B 23/04*** | (2006.01) |
| ***E21B 34/06*** | (2006.01) |
| *E21B 34/00* | (2006.01) |

(52) U.S. Cl.

CPC ..... *E21B 43/105* (2013.01); *E21B 23/04* (2013.01); *E21B 34/06* (2013.01); *E21B 43/108* (2013.01); *E21B 2034/002* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,075,924 | A * | 2/1978 | McSherry | F16B 13/0808 411/112 |
| 7,222,669 | B2 | 5/2007 | Sonnier et al. | |
| 7,493,946 | B2 | 2/2009 | Filippov et al. | |
| 7,779,910 | B2 | 8/2010 | Watson | |
| 7,823,659 | B2 | 11/2010 | Costa et al. | |
| 7,845,421 | B2 | 12/2010 | Braddick | |
| 2004/0159446 | A1* | 8/2004 | Haugen | E21B 43/103 166/384 |

OTHER PUBLICATIONS

International Search Report and Written Opinion dated Sep. 25, 2013 for Application No. PCT/US2013/021079.

* cited by examiner

*Primary Examiner* — William P Neuder
*Assistant Examiner* — Ronald Runyan
(74) *Attorney, Agent, or Firm* — Haynes and Boone, LLP

(57) ABSTRACT

Disclosed is a tubular expansion tool which includes a plurality of stackable piston/slip/spring assemblies that are used to radially expand a liner against well casing along a longitudinal distance "L." The pistons are repeatedly stroked a short distance "S" with the application of hydraulic pressure. As the pistons are stroked, they move a mandrel-expansion die sub assembly in successive steps a distance "S" to perform the tubular expansion over a longer distance "L."

15 Claims, 10 Drawing Sheets

STEPPED LINER HANGER EXPANDER

CROSS REFERENCE TO RELATED APPLICATIONS

This application is a U.S. National Stage Entry of International Application No. PCT/US2013/021079, filed Jan. 10, 2013, the entire disclosure of which is hereby incorporated herein by reference.

BACKGROUND

1. Technical Field

The present invention relates to equipment and methods used in subterranean wells, and more particularly, to apparatus for expanding liner hangers.

2. Background Art

In the process of drilling and completing hydrocarbon wells, it is common place to use heavy steel casing in a well and to place cement between the casing and the well to anchor the casing in place and prevent migration of fluids along the annulus outside the casing. After an upper portion of a well has been drilled and casing is cemented in place, it is common to resume drilling the well and install a liner in the lower part of the well by lowering the liner through the upper-cased portion of the well. Liner hangers are used to mechanically support the upper end of the liner at the lower end of the previously set casing and to seal the liner to the casing. Liner hangers have included slips for mechanical support and packers for forming a seal.

In addition, liner hangers that can be expanded against the wall of the previously set casing, such as those sold under the trademark VERSAFLEX®, by Halliburton Energy Services, have been developed. Expandable liner hangers provide both mechanical support and a fluid seal by use of a number of elastomeric rings carried on a section of expandable liner. In operation, the liner hanger is properly positioned in a cased portion of a well, and an expansion device is forced through the liner hanger to expand the liner hanger into the casing wall, compressing the elastomeric seals to provide both mechanical support and a fluid seal.

Systems for expanding liner hangers, such as, disclosed in U.S. Pat. No. 7,779,910, include an expansion cone having a first outer diameter when driven through the expandable liner hanger in a first direction to expand the expandable portion of the liner. The expandable liner hanger system also includes at least one piston to force the cone through the expandable portion of the liner hanger. The expansion process involves supplying pressure to the pistons.

Current liner expansion practice involves stroking the pistons approximately between 40 to 60 inches with a single surface pressure application. While effective, this method requires multiple pistons, each having a stroke length sufficient to move the cone the required expansion distance as well as additional distance for manipulation in the case of incomplete expansion. However, industry trends are moving toward heavier weight casing and higher pressures, which all act to increase the number of pistons required in the setting tool which, in turn, increases the length, handling, weight, and complexity of the setting tool. In some cases, even taking the pumping equipment to their pressure limits cannot effectively expand these heavier liners.

SUMMARY OF THE INVENTIONS

Instead of a single pressure application that strokes the entire length of the expandable liner portion, the present inventions use a series of successive pressure applications to achieve the same expansion at lower pressures.

The present inventions incorporate an expansion tool, which includes a plurality of stackable piston/slip/spring assemblies that are used to radially expand a liner against well casing along a longitudinal distance "L". The pistons are repeatedly stroked a short distance "S" with the application of pumping pressure. The pistons move a mandrel-expansion cone sub assembly in successive steps a distance "S" to perform the liner expansion over a longer distance "L." The tool reduces the necessary expansion pressure, reduces the overall length of the tool, and more accurately controls expansion force.

BRIEF DESCRIPTION OF THE DRAWINGS

The drawing is incorporated into and forms a part of the specification to illustrate at least one embodiment and example of the present invention. Together with the written description, the drawing serves to explain the principles of the invention. The drawing is only for the purpose of illustrating at least one preferred example of at least one embodiment of the invention and is not to be construed as limiting the invention to only the illustrated and described example or examples. The various advantages and features of the various embodiments of the present invention will be apparent from a consideration of the drawing in which.

DETAILED DESCRIPTION

Figure 1:
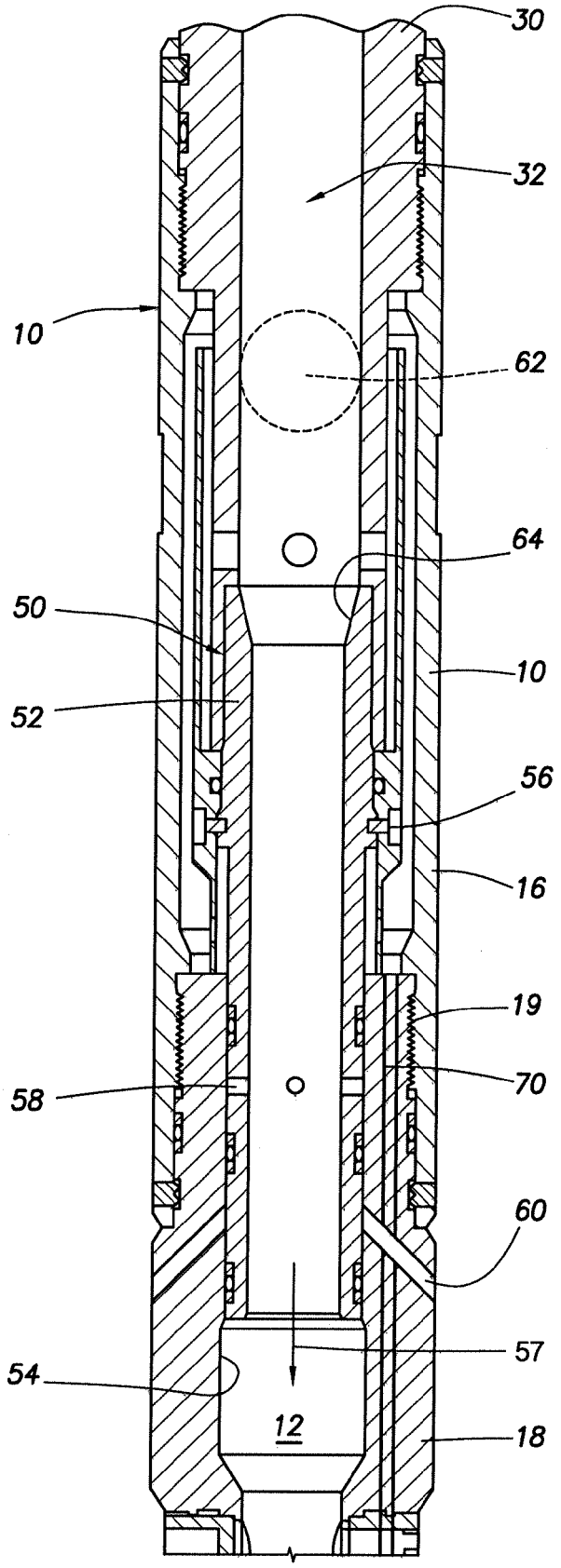
FIGS. 1-9 are longitudinal section views of different portions of liner hanger expander apparatus of the present invention.
Figure 2:
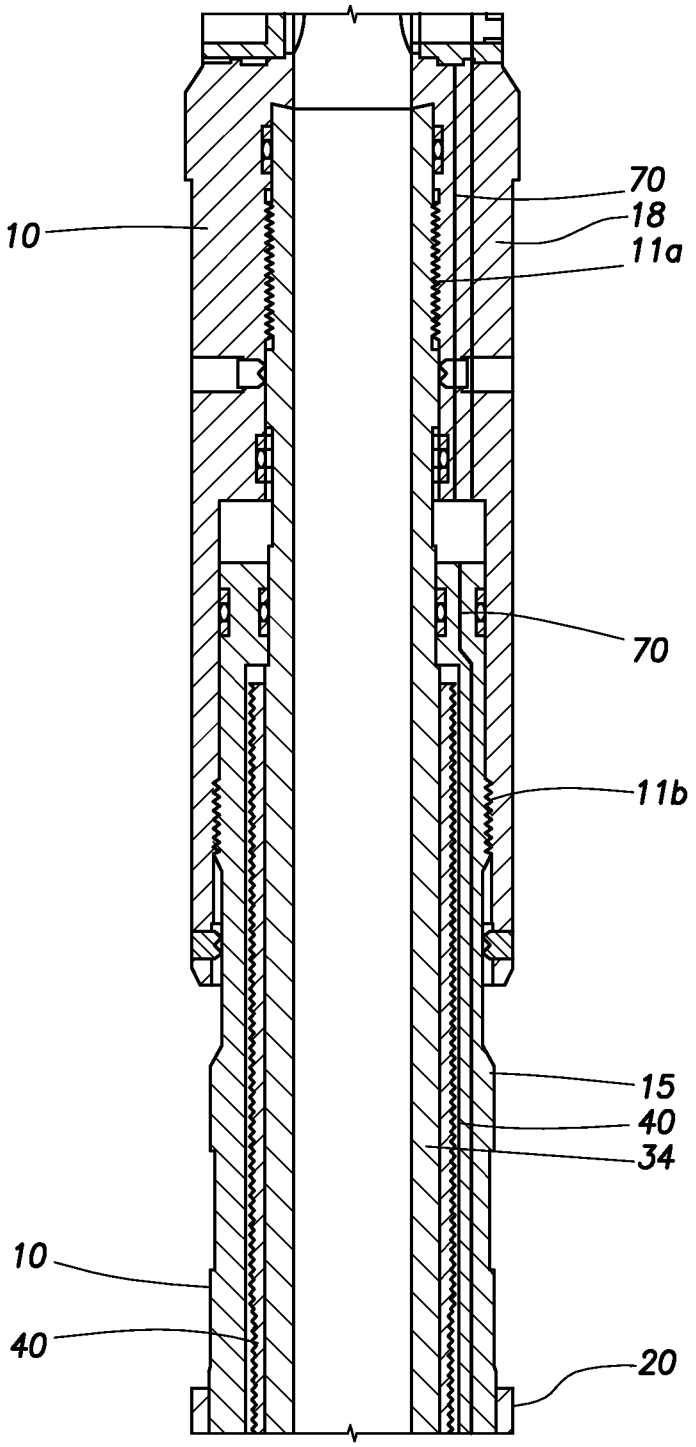

The present invention provides an improved apparatus and method for expanding liners and other tubular member at a subterranean location in a wellbore. The present invention provides stackable piston assemblies which operate in parallel and therefore reduce the pressure necessary to expand a liner hanger.

Referring more particularly to the drawings, wherein like reference characters are used throughout the various figures to refer to like or corresponding parts, there is shown in FIGS. 1-9 one embodiment of a pressure-operated expansion tool 10 of the present invention is connected by threads to a running tool 30. Typically the running tool is lowered into the well on the lower end of a tubing string. The center bore 32 of the running tool 30 is connected to the center bore 12 of the tool 10. The tool 10 is positioned at the lower end 28 of the cased wellbore 14. An assembly, comprising a conventional polished bore receptacle (PBR) 20, liner hanger 22 and liner 24, is suspended from exterior of the expansion tool 10 and run into the well to extend below the bottom edge of the casing 14. As will be explained, the liner hanger 22 will be expanded radially outward against wellbore casing 14 along a longitudinal length "L." The upper end of tool 10 acts as a crossover tool and comprises an upper crossover section 16 and lower crossover section 18, threaded together at 19. An adapter 15 extends from the lower end of the lower crossover section 18.

A valve assembly 50, mounted in the tool 10, comprises a spool-shaped valve element 52 positioned in a cylindrical relief 54 in the tool 10. Shear pins 56 resist longitudinal movement of valve element 52 in the direction of arrow 57, along relief 54. When the valve element 52 is in the run position illustrated in FIG. 1, ports 58 and 60 are not connected. Valve element 52 can be moved or shifted down in the direction of arrow 57 by first dropping a ball 62 onto the seat 64 and then raising the pressure to shear pins 56. In the shifted position, ports 58 and 60 are aligned, connecting the cased wellbore annulus to the central bore 12 of the tool 10 at a point below the ball 62.

According to the present invention, the expansion tool comprises a tubular inner mandrel 34 connected by threads 11*a* to the adapter 15. In addition, the expansion tool 10 comprises a plurality of piston/slip/spring subassemblies that are stacked in the tool and connected in parallel to an expansion mandrel 40, so that the forces exerted by the pistons on the mandrel 40 are cumulative. In the illustrated embodiment of the tool 10, four piston/cylinder/slip/spring subassemblies 100, 200, 300 and 400 are present. It is envisioned that more or less piston/cylinder/slip/spring subassemblies could be used as required by the situation. Piston/cylinder/slip/spring subassemblies 100, 200, 300 and 400 are illustrated in FIGS. 3, 4, 5 and 6, respectively. As will be explained, each of the piston/cylinder/slip/spring subassemblies can be repeatedly stroked a longitudinal distance "S" by raising and lowering the pressure in the tubing string subsequent to dropping a ball 62 and its landing on ball seat 64.

A port system 70 in the tool connects the center bore 12 to the cylinders of each of the subassemblies 100, 200, 300 and 400, together in fluid communication. The port system 70 is in fluid communication with the center bore 12 at a point above the valve assembly 50. The port system 70 is connected at 72 to the sealed annular space between the tool 10 and the PBR 20. Each of the cylinders of the subassemblies 100, 200, 300 and 400 are connected to the sealed annular space inside the PBR at 170, 270,370 and 470, respectively.

According to a particular feature of the present inventions, the four piston/cylinder/slip/spring subassemblies 100, 200, 300 and 400 act as actuators for the expansion mandrel 40. Piston/cylinder/slip/spring subassembly 100 has its upper end threaded into the adapter 15 at 102 (see FIG. 3).

Figure 4:
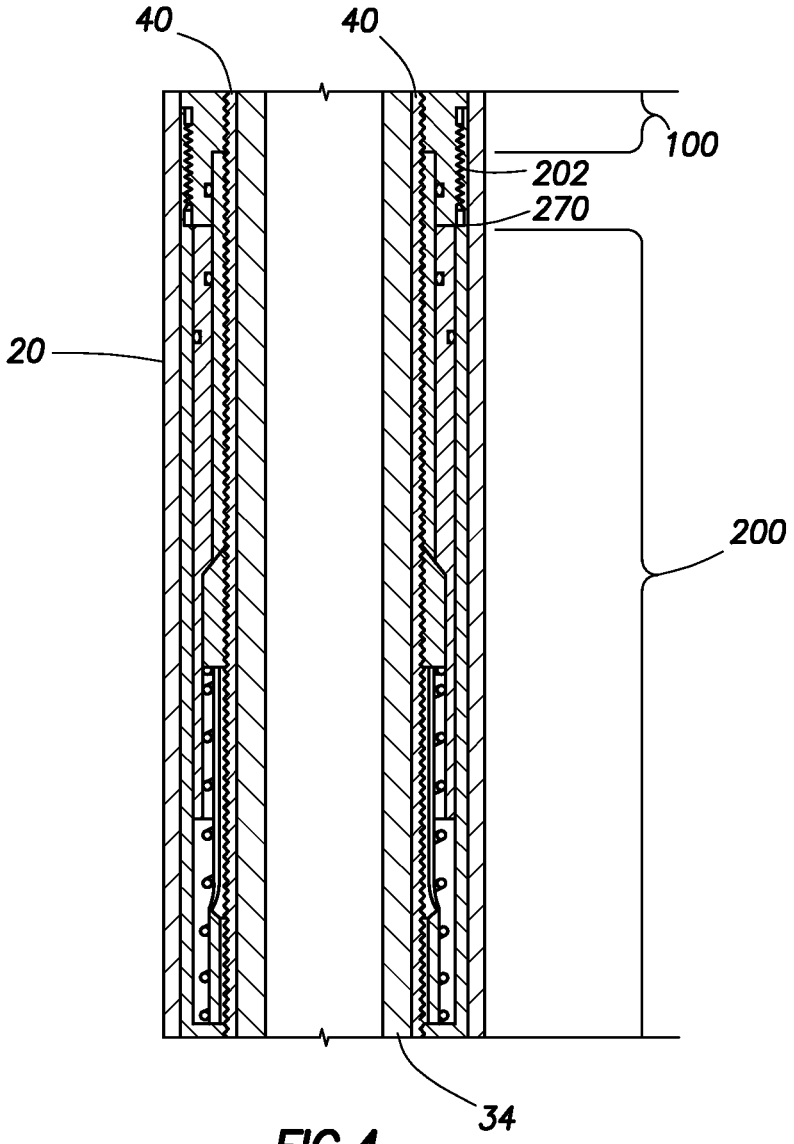
Figure 5:
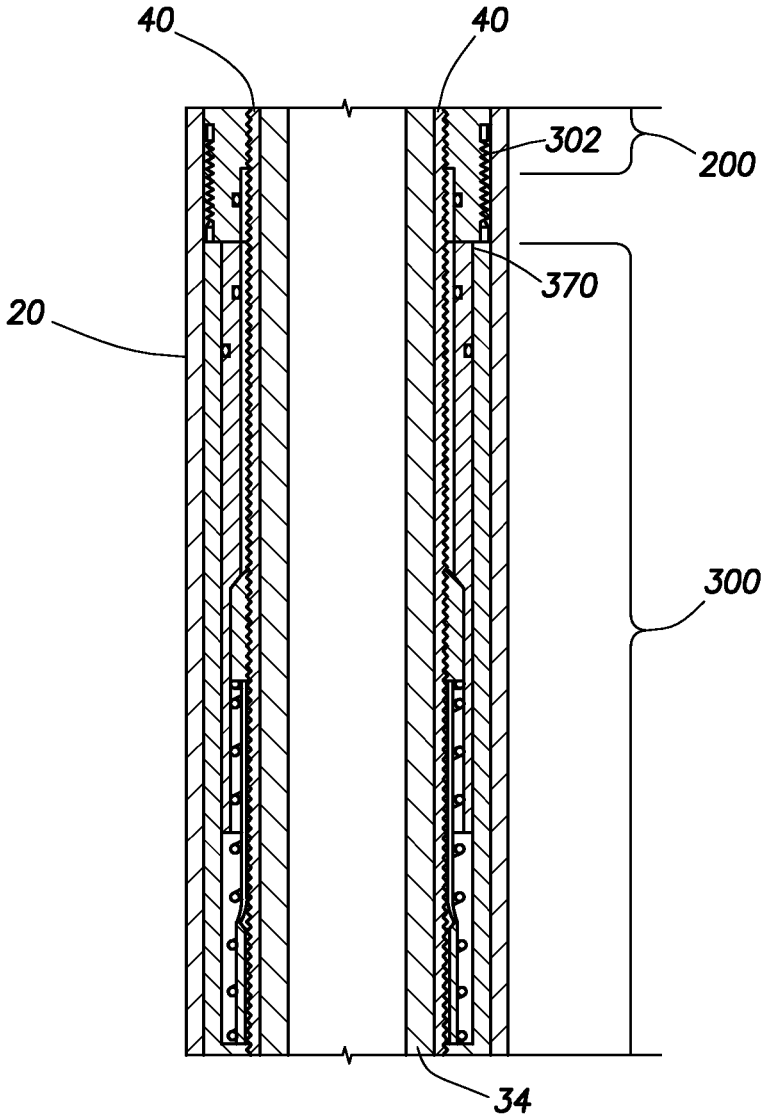
Figure 6:
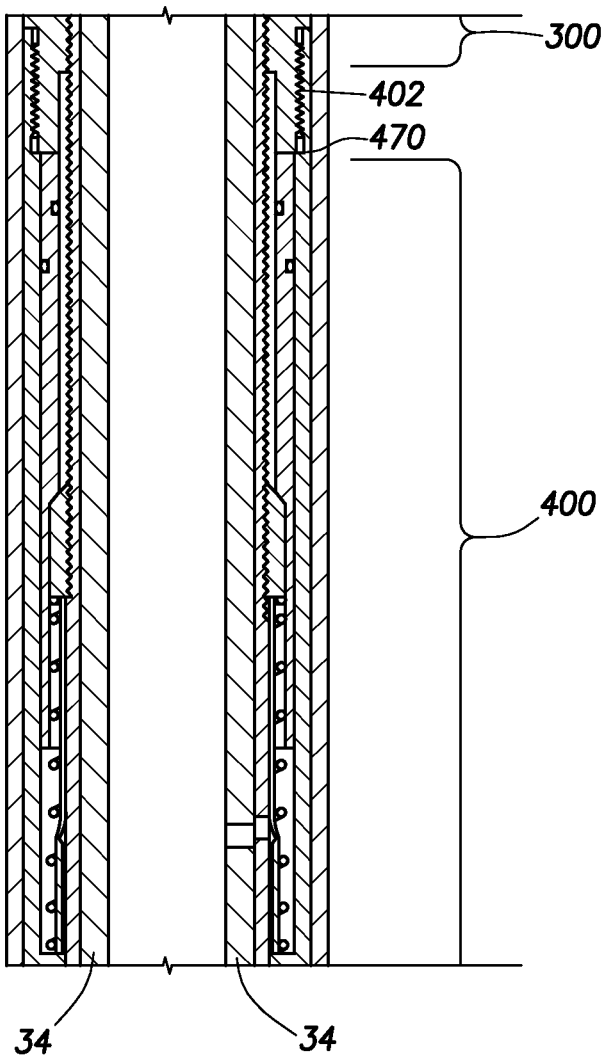
Figure 7:
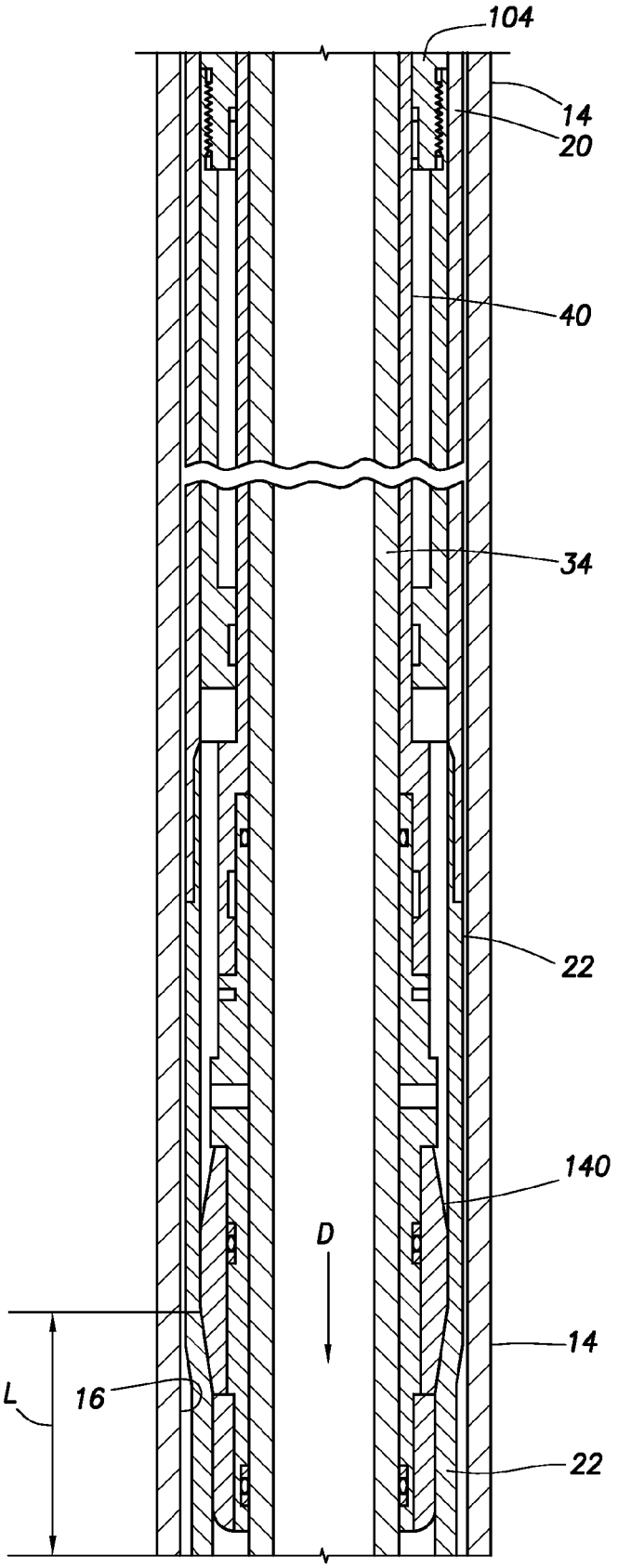
Figure 8:
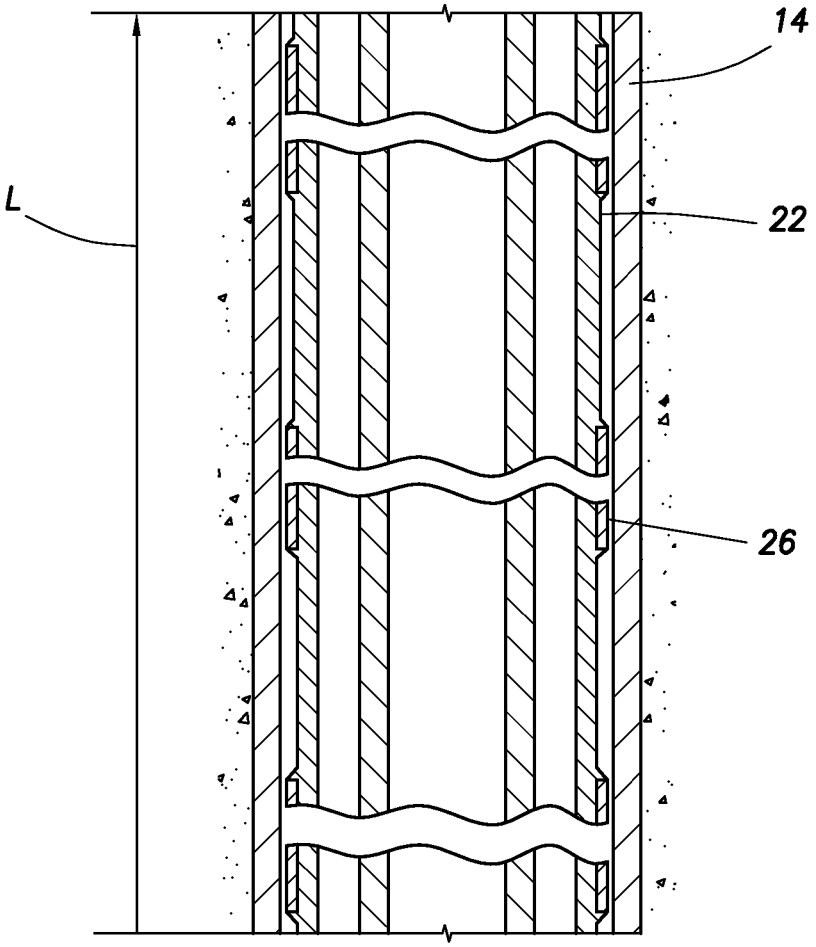
Figure 9:
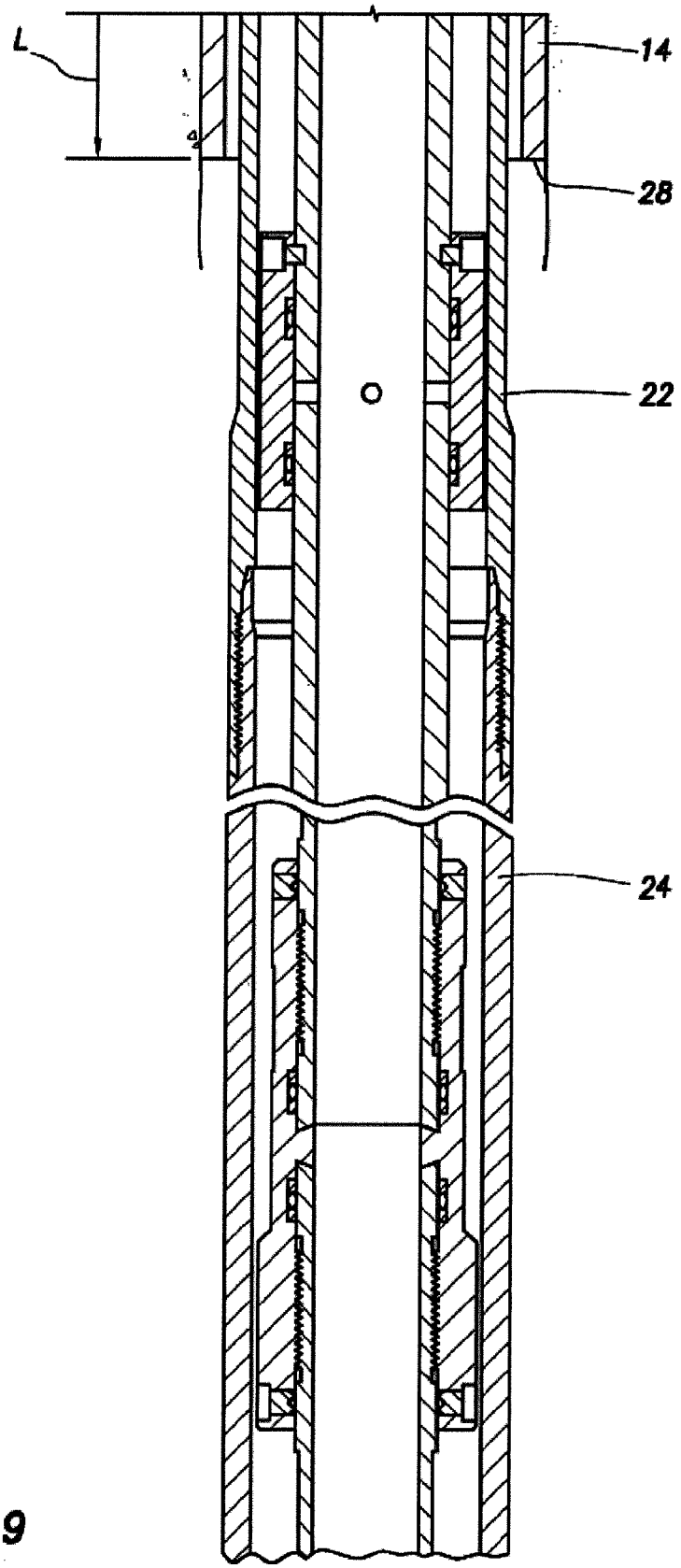

The upper end of subassembly 200 is threaded at 202 into the lower end of subassembly 100 (see FIG. 4). In a similar manner, threads 302 connect subassemblies 300 to subassembly 200 (see FIG. 5) and threads 402 connect subassembly 400 to subassembly 300 (see FIG. 6).

As will be described in detail, each piston/cylinder/slip/spring subassembly, when actuated, applies a downward force on the expansion mandrel 40 to expand the liner hanger. The forces applied by the subassemblies are cumulative as the piston/cylinder/slip/spring subassemblies are arranged in parallel. According to the present inventions, as many piston/cylinder/slip/spring subassemblies as are needed can be threaded together end-to-end to provide the force necessary to expand the particular liner hanger.

Piston/cylinder/slip/spring subassemblies 100, 200, 300 and 400 are located in the annular space between the PBR 20 and the tubular inner mandrel 34. The tubular expansion mandrel 40 is positioned between the inner mandrel 34 and the piston/cylinder/slip/spring subassemblies 100, 200, 300 and 400.

The piston/cylinder/slip/spring subassemblies will be described in detail by reference to subassembly 100 and FIG. 3. The structure of subassembly 100 is typical of the structure of subassemblies 200, 300 and 400. In subassembly 100, an annular variable volume chamber 107 is formed between the outer cylindrical member 104 and inner cylindrical member 106. Outer cylinder member 104 is threaded into the adapter 15. Passageway 170 connects the upper end of this chamber 107 with the ports 70.

An annular piston 108 is mounted in the cylinder to reciprocate or stroke in chamber 107 in the forward and reverse direction of arrow "D." As pressure is applied to ports 72 the chamber 107 will expand or increase in volume and piston 108 will be forced to move downward in the direction of arrow "D." The length "S" of the downward stroke of the piston 108 is limited by engagement between lower end 110 of the piston 108 with the shoulder 112 on the outer cylinder member 104. By stacking a plurality of piston-cylinder assemblies together a lower pressure is required to achieve expansion, such that, more piston-cylinders assemblies equates to a lower expansion pressure. Likewise, because of the aforementioned stroke limitation of the pistons, pressurization beyond that required for expansion results only in generation of internal forces. As used herein, the piston-cylinder assembly of the subassembly 100 could be formed by an annular piston and cylinder wall, forming an annular variable volume chamber; however, other shapes of pistons and chambers could be used in accordance with the present inventions. Accordingly the term "piston-cylinder assembly" is used herein to mean a piston that reciprocates in a variable volume chamber formed by walls.

A plurality of slip elements 120 are mounted in slots 114, formed in the inner cylindrical member 106. A helical coil spring 130 is positioned between the shoulder 112 on outer cylinder member 104 and lower faces 122 on slip elements 120. Spring 130 urges the slip element in the first direction of arrow "D." The compression spring is illustrated as a coil spring, but it could be a set of Belleville washers, wave spring, or similar spring element. While a return spring is shown, annular pressure could be applied between the casing and drill string to return the pistons to their up position before the next pressure application.

The upper faces 124 of the slip elements 120 are inclined radially outward. These upper faces 124 rest against an inward facing shoulder 114 on the piston 108. The inner surface of the slips 120 have teeth 126 which contact teeth 42 on the expansion mandrel 40. These teeth, like the teeth on a ratchet, are orientated so that they engage in one direction and slip in the opposite direction. Thus, the piston-cylinder assembly is connected to the expansion mandrel 40 by a single direction connection that can apply lateral force to the expansion mandrel when the piston moves in one direction and slips when the piston moves in the opposite direction. As used herein the term "single direction connection" is used herein to refer to a connection that allows relative movement in one direction by preventing relative movement in the opposite direction.

In operation, as pressure is applied through ports 72 the cylinder of subassembly 100, piston 108 will move or stroke a distance "S" in the direction of arrow "D" until end 110 engages shoulder 112. During the piston's stroke in the direction of arrow "D", engagement of surface 114 and the slips upper face 124 will force the slips 120 inward against expansion mandrel 40. As the piston strokes downward, the teeth on the slips and the teeth on the expansion mandrel 40 will engage and apply force, tending to move expansion mandrel 40 downward in the direction of arrow "D."

Figure 3:
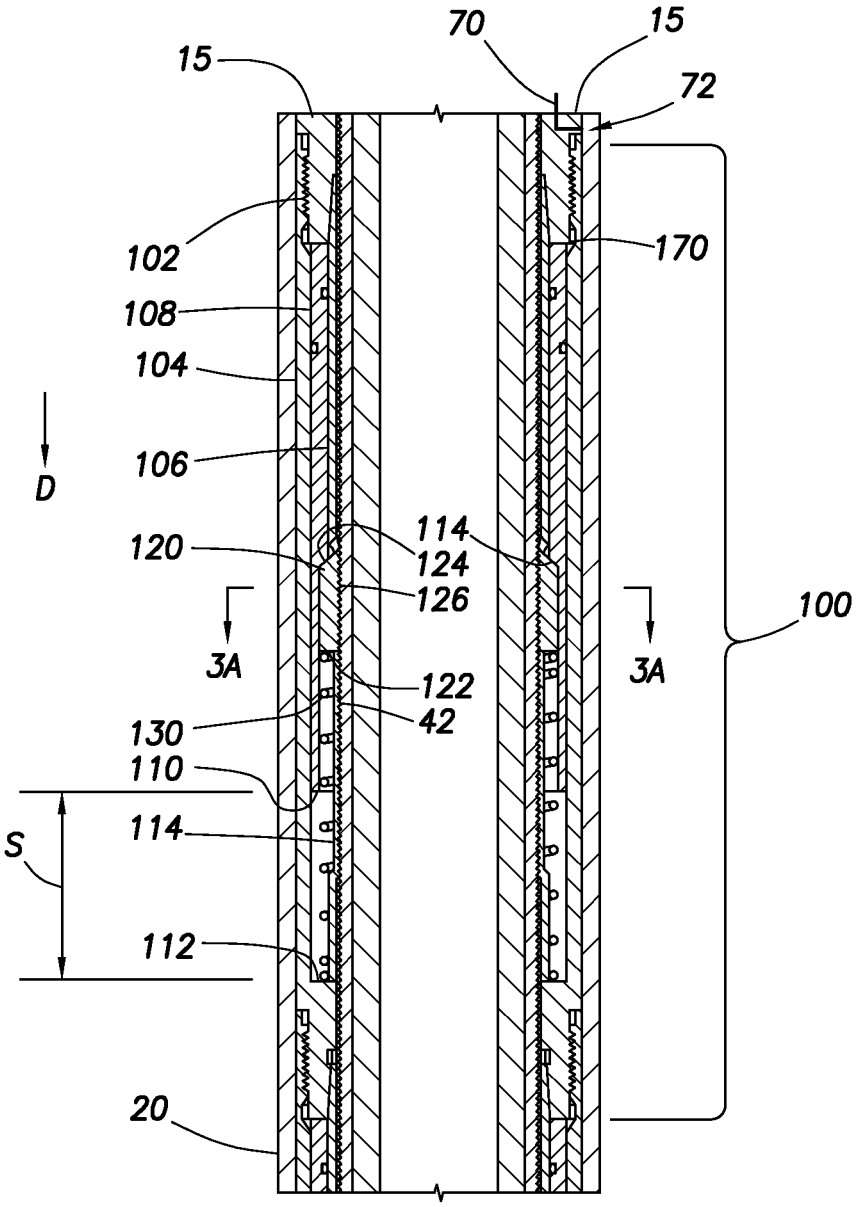
Figure 3A:
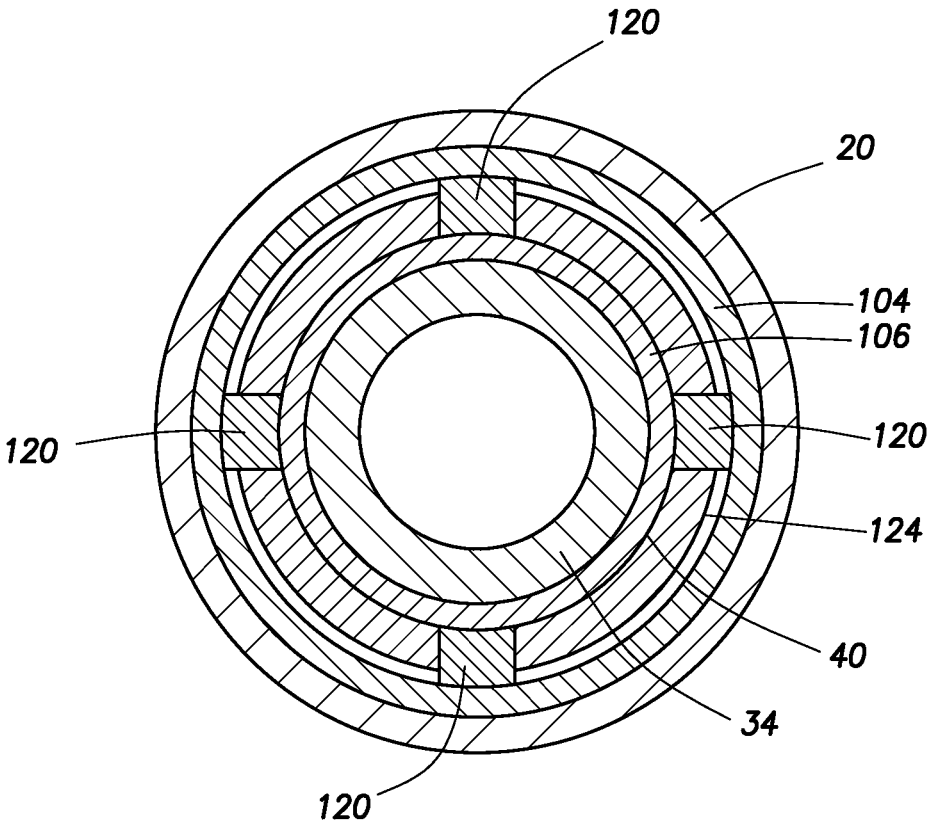
FIG. 3A is a cross-section view taken on lines 3A-3A of FIG. 3, looking in the direction of the arrows.

When the pressure applied through ports 72 is reduced, spring 130 will force the piston 108 in the reverse direction of arrow "D" to the position illustrated in FIG. 3. During this return motion, the teeth 126 on the slip elements 120 will "slip" with respect to the teeth 42 on expansion mandrel 40. While an element that provides directional application of force in one direction and is allowed to slip in the return direction is required, it may be incorporated in multiple ways. The use of threads is used here and is, therefore, the preferred embodiment. Additional methods may be used, for example, roller bearings, a helical spring wound around a mandrel, or even a rubber/metal hybrid element to provide a gripping means upon application of pressure and release, upon release of pressure.

In operation, pressure is applied to the expansion tool 10 to expand the liner hanger 22 against the lower end of the cased wellbore 14 to form a connection between the wellbore casing and the liner hanger. This process will be described by referring to FIGS. 7-9.

As the piston 108 moves (and the other pistons in the assembly move) down in the direction "D," with the slips 120 engaging an expansion mandrel 40, force from the piston is projected to a cone-shaped expansion die 140. The die 140 will be forced along the interior of the liner hanger 22, radially deforming outward (expanding) the liner hanger 22 to compress radial seals 22 against the interior wall of the casing 14. Each time the piston (or pistons) stroke the distance "S," die 140 is moved along the length of the liner hanger a distance "S." When the pressure is reduced, the pistons retract but the die 140 remains in position and when the pressure is applied a second time, the pistons stroke and move the die 140 a second distance "S." The pressure cycling can be repeated until the die 140 has moved through the entire length "L" of the liner hanger. Thereafter, the assembly can be retracted from the liner, leaving the liner hung on the interior wall of the casing.

In this manner, the advantages of this invention is achieved, i.e., providing a means of reducing expansion pressure, reducing the overall length of running tools, eliminating the need for a break-apart mechanism, more accurately controlling expansion pressure, and providing redundancy with a short stackable piston/slip mechanism.

While compositions and methods are described in terms of "comprising," "containing," or "including" various components or steps, the compositions and methods also can "consist essentially of" or "consist of" the various components and steps. As used herein, the words "comprise," "have," "include," and all grammatical variations thereof are each intended to have an open, non-limiting meaning that does not exclude additional elements or steps.

Therefore, the present inventions are well adapted to carry out the objects and attain the ends and advantages mentioned as well as those which are inherent therein. While the invention has been depicted, described, and is defined by reference to exemplary embodiments of the inventions, such a reference does not imply a limitation on the inventions, and no such limitation is to be inferred. The inventions are capable of considerable modification, alteration, and equivalents in form and function, as will occur to those ordinarily skilled in the pertinent arts and having the benefit of this disclosure. The depicted and described embodiments of the inventions are exemplary only, and are not exhaustive of the scope of the inventions. Consequently, the inventions are intended to be limited only by the spirit and scope of the appended claims, giving full cognizance to equivalents in all respects.

For example, the expansion mandrel is described as incorporating serrated teeth all along its length, and the slips use a matching set of teeth to engage and transmit force linearly. The slip angle would most likely be 10 degrees. While serrated teeth are shown, a coarser element could be incorporated to achieve the same end. Possibly, a roller element could be used with a smooth expansion mandrel. While a piston/slip/spring mechanism can be used, multiple units could be stacked to provide redundancy to more closely control required pumping pressure. Alternatively, on the low end of pressure, a spring relief valve could be used in the stackable housing to only expand after a set pressure is achieved, preventing undesirable low pressure events that could interfere with float equipment.

Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

The invention claimed is:

1. A method for radially expanding a tubular in a subterranean well along a longitudinal length "L", wherein the tubular has an internal diameter "D" along the longitudinal length "L", the method comprising:

inserting the tubular in the subterranean well;

providing an expansion die with an outer diameter greater than the internal diameter "D", the expansion die being operably connected to a hydraulic piston-cylinder assembly having a stroke length "S" that is less than the longitudinal length "L";

providing a ratchet assembly operably connecting the hydraulic piston-cylinder assembly to the expansion die, the ratchet assembly comprising an elongated annular member and a single-direction slip connection between the elongated annular member and the hydraulic piston-cylinder assembly, the elongated annular member extending between the expansion die and the hydraulic piston-cylinder assembly; and repeatedly actuating the hydraulic piston-cylinder assembly along the stroke length "S" so that the expansion die is forced to move longitudinally along the interior of the tubular in a first axial direction for a distance equal to the longitudinal length "L", thus expanding the tubular along the longitudinal length "L";

wherein, when the hydraulic piston-cylinder assembly is repeatedly actuated along the stroke length "S", the ratchet assembly prevents, or at least restricts, movement of the hydraulic piston-cylinder assembly relative to the expansion die in the first axial direction, and allows movement of the hydraulic piston-cylinder assembly relative to the expansion die in a second axial direction, which is opposite the first axial direction.

2. A method for radially expanding a tubular in a subterranean well along a longitudinal length "L", wherein the tubular has an internal diameter "D" along the longitudinal length "L", the method comprising:

inserting the tubular in the subterranean well;

providing an expansion die with an outer diameter greater than the internal diameter "D", the expansion die being operably connected to a hydraulic piston-cylinder assembly having a stroke length "S" that is less than the longitudinal length "L";

connecting a valve to the hydraulic piston-cylinder assembly, the valve comprising an axially slideable valve sleeve having an annular seat;

connecting the hydraulic piston-cylinder assembly to a tubing string and lowering the hydraulic piston-cylinder assembly into the subterranean well;

moving a valve member through the tubing string to seal on the annular seat so that the hydraulic piston-cylinder assembly is in fluid communication with the interior of the tubing string and, thereafter, repeatedly raising and reducing pressure in the tubing string to repeatedly actuate the hydraulic piston-cylinder assembly along the stroke length "S"; and raising pressure in the tubular string to shift the valve;

wherein repeatedly actuating the hydraulic piston-cylinder assembly along the stroke length "S" causes the expansion die to move longitudinally along the interior of the tubular for a distance equal to the longitudinal length "L", thus expanding the tubular along the longitudinal length "L".

3. An apparatus for expanding a tubular member in a well at a subterranean location, the apparatus comprising:

an expansion die of a size to radially expand the tubular member along a length;

a hydraulic piston-cylinder assembly operable for forcing the expansion die through the tubular member; and a connection operably connecting the hydraulic piston-cylinder assembly to the expansion die, the connection comprising an elongated annular member extending between the expansion die and the hydraulic piston-cylinder assembly and a single-direction slip connection between the piston cylinder assembly and the elongated annular member;

wherein the single-direction slip connection between the hydraulic piston-cylinder assembly and the elongated annular member comprises slips and ratchet teeth on the elongated annular member.

4. The tubular member expansion apparatus according to claim 3, wherein the hydraulic piston-cylinder assembly comprises a plurality of hydraulic piston-cylinder assemblies connected in parallel.

5. The tubular member expansion apparatus according to claim 3, wherein the tubular member is a liner.

6. The tubular member expansion apparatus according to claim 3, wherein the hydraulic piston-cylinder assembly comprises a cylinder that forms an annular chamber and an annular piston mounted to move in the annular chamber.

7. An apparatus for expanding a tubular member in a well at a subterranean location, the apparatus comprising:

an expansion die of a size to radially expand the tubular member along a length;

a hydraulic piston-cylinder assembly connected to the expansion die and operable to force the expansion die through the tubular member at the subterranean location;

an elongated annular member extending between the expansion die and the hydraulic piston-cylinder assembly;

a single-direction slip connection between the hydraulic piston-cylinder assembly and the elongated annular member; and a valve connected to the hydraulic piston-cylinder assembly, the valve comprising an axially slideable valve sleeve having an annular seat against which a valve member is adapted to seal so that the hydraulic piston-cylinder assembly is in fluid communication with the interior of the tubing string; and a tubing string to which the hydraulic piston-cylinder assembly is connected, the tubing string being adapted to lower the hydraulic piston-cylinder assembly into the subterranean well.

8. The tubular member expansion apparatus according to claim 7, wherein the piston-cylinder assembly comprises a plurality of piston-cylinder assemblies connected in parallel.

9. The tubular member expansion apparatus according to claim 7, wherein the tubular member is a liner.

10. The tubular member expansion apparatus according to claim 7, wherein the hydraulic piston-cylinder assembly comprises a cylinder that forms an annular chamber and an annular piston mounted to move in the annular chamber.

11. A well tool assembly for radially expanding a tubular member at a subterranean location in a well, the well tool assembly comprising:

a tubular well string of sufficient length to extend into the well to the subterranean location; and an expansion apparatus operably supported from the tubular well string, the expansion apparatus comprising:

an expansion die of a size to radially expand the tubular member along a length;

a hydraulic piston-cylinder assembly operable for forcing the expansion die through the tubular member; and a connection operably connecting the hydraulic piston-cylinder assembly to the expansion die, the connection comprising an elongated annular member extending between the expansion die and the hydraulic piston-cylinder assembly and a single-direction slip connection between the hydraulic-piston cylinder assembly and the elongated annular member;

wherein the single-direction slip connection between the hydraulic piston-cylinder assembly and the elongated annular member comprises slips and ratchet teeth on the elongated annular member.

12. The well tool assembly according to claim 11, wherein the hydraulic piston-cylinder assembly comprises a plurality of separate hydraulic piston-cylinder assemblies operably connected in parallel to the expansion die.

13. The well tool assembly according to claim 11, further comprising a valve connected to the hydraulic piston-cylinder assembly, the valve comprising an axially slideable valve sleeve having an annular seat against which a valve member is adapted to seal so that the hydraulic piston-cylinder assembly is in fluid communication with the interior of the tubing string.

14. The well tool assembly according to claim 11, wherein the piston-cylinder assembly comprises a cylinder, forming an annular chamber and an annular piston mounted to move in the annular chamber.

15. An apparatus for expanding a tubular along a longitudinal length in a subterranean well, the apparatus comprising:

an expansion die sized to radially expand the tubular along the longitudinal length;

a hydraulic piston-cylinder assembly connected to the expansion die and operable to force the expansion die through the tubular at the subterranean location, the hydraulic piston-cylinder assembly having a stroke length that is less than the longitudinal length; and a ratchet assembly operably connecting the hydraulic piston-cylinder assembly to the expansion die, the ratchet assembly comprising an elongated annular member and a single-direction slip connection between the elongated annular member and the hydraulic piston-cylinder assembly, the elongated annular member extending between the expansion die and the hydraulic piston-cylinder assembly;

wherein the hydraulic piston-cylinder assembly is adapted to be repeatedly actuated along the stroke length so that the expansion die is forced to move longitudinally along the interior of the tubular in a first axial direction for a distance equal to the longitudinal length, thus expanding the tubular along the longitudinal length: and wherein, when the hydraulic piston-cylinder assembly is repeatedly actuated along the stroke length, the ratchet assembly prevents, or at least restricts, movement of the hydraulic piston-cylinder assembly relative to the expansion die in the first axial direction, and allows movement of the hydraulic piston-cylinder assembly relative to the expansion die in a second axial direction, which is opposite the first axial direction.

* * * * *